US011399624B2

(12) United States Patent
Akridge

(10) Patent No.: US 11,399,624 B2
(45) Date of Patent: Aug. 2, 2022

(54) SKINCARE DEVICE HAVING OPTIMIZED DUAL ENERGY MODALITIES, AND ASSOCIATED SYSTEMS AND METHODS

(71) Applicant: L'Oreal, Paris (FR)

(72) Inventor: Robert E. Akridge, Redmond, WA (US)

(73) Assignee: L'Oreal, Paris (FR)

( * ) Notice: Subject to any disclaimer, the term of this patent is extended or adjusted under 35 U.S.C. 154(b) by 636 days.

(21) Appl. No.: 16/224,608

(22) Filed: Dec. 18, 2018

(65) Prior Publication Data

US 2020/0187635 A1 Jun. 18, 2020

(51) Int. Cl.

| | |
|---|---|
| ***A46B 13/02*** | (2006.01) |
| ***A46B 13/00*** | (2006.01) |
| *A61H 23/02* | (2006.01) |

(52) U.S. Cl.

CPC ..... *A46B 13/023* (2013.01); *A46B 13/008* (2013.01); *A46B 2200/102* (2013.01); *A61H 23/02* (2013.01); *A61H 2205/022* (2013.01)

(58) Field of Classification Search

CPC ..... A46B 13/023; A46B 13/008; A46B 2200/102; A46B 2200/1006; A46B 15/0055; A46B 5/0008; A61H 23/02; A61H 2205/022; A61H 11/02; A61H 7/001; A61H 7/002; A61H 7/003; A61H 2023/002; A61H 23/004; A61H 23/008; A61H 23/0254; A61H 23/06; A61H 2201/0153; A61H 2201/0157; A61H 2201/1207; A61H 2201/1215; A61H 2201/1253; A61H 2201/1635; A61H 2201/1638; A61H 2201/1645; A61H 2201/1692; A61H 2201/1695; A61H 7/004–005;

(Continued)

(56) References Cited

U.S. PATENT DOCUMENTS 3,019,785 A * 2/1962 Eiden ..... 601/58
4,158,246 A * 6/1979 Meadows ..... B24B 23/02 15/28

(Continued)

FOREIGN PATENT DOCUMENTS

| | | |
|---|---|---|
| CN | 204246039 U | 4/2015 |
| DE | 94 17 873.9 U1 | 3/1995 |
| WO | 2015138212 A1 | 9/2015 |

OTHER PUBLICATIONS

Nanomotion, "The Piezoelectric Effect," [Accessed from the internet on Jun. 2, 2021, from the URL: https://www.nanomotion.com/nanomotion-technology/piezoelectric-effect/] (Year: 2021).*

(Continued)

*Primary Examiner* — Justine R Yu
*Assistant Examiner* — Benjamin M. Kusiak
(74) *Attorney, Agent, or Firm* — Christensen O'Connor Johnson Kindness PLLC

(57) ABSTRACT

A skincare device having optimized dual energy modalities ace is presented. In an embodiment, a skincare device includes a body having protruding elements configured for contacting a skin of a user, where the protruding elements are configured to vibrate in operation. The skincare device also includes an end effector configured for contacting the skin of the user, where the end effector is configured to oscillate about a center axis in operation.

20 Claims, 9 Drawing Sheets

(58) Field of Classification Search
CPC .. A61H 23/0245; A61H 39/007; A47K 7/043; A61C 17/34; A61C 17/3409; A61C 17/3418; A61C 17/3481
See application file for complete search history.

(56) References Cited

U.S. PATENT DOCUMENTS 6,228,041 B1* 5/2001 Ameer ..... A61H 23/02 601/46
6,505,361 B1* 1/2003 Ogawa ..... B06B 1/161 5/109
D698,455 S * 1/2014 Sedic ..... A61H 23/004 D24/215
D773,064 S * 11/2016 Sedic ..... D24/214
D837,994 S * 1/2019 Sedic ..... D24/214
D845,630 S * 4/2019 Sedic ..... D4/100
D852,972 S * 7/2019 Sedic ..... D24/214
D857,221 S * 8/2019 Sedic ..... D24/215
2005/0054957 A1* 3/2005 Yamazaki ..... A61H 23/0245 601/46
2005/0267388 A1* 12/2005 Hanna ..... A61H 23/02 601/79
2007/0123808 A1* 5/2007 Rhoades ..... A46B 5/0016 601/73
2008/0308118 A1* 12/2008 Taggart ..... A46B 13/02 132/119.1
2009/0019651 A1* 1/2009 Grez ..... A61C 17/222 15/22.1
2010/0249677 A1* 9/2010 DiUbaldi ..... A61H 23/0245 601/46
2011/0119843 A1* 5/2011 Nikitczuk ..... A46B 11/002 15/21.1
2012/0191023 A1* 7/2012 Young ..... B32B 29/02 601/18
2012/0259255 A1* 10/2012 Tomlinson ..... A61H 23/0218 601/46
2013/0023901 A1* 1/2013 Sanchez-Martinez ..... A46B 13/02 606/133
2013/0263880 A1* 10/2013 Pires ..... A46B 13/00 132/218
2014/0194900 A1* 7/2014 Sedic ..... A47K 7/043 606/131
2015/0105802 A1 4/2015 Sedic
2015/0119769 A1* 4/2015 Golbin ..... A61M 21/00 601/48
2015/0141884 A1* 5/2015 Thiebaut ..... A45D 34/042 601/154
2015/0150754 A1* 6/2015 Kadra ..... A61H 7/005 601/81
2015/0173998 A1* 6/2015 Thiebaut ..... A61H 7/005 601/114
2015/0196452 A1* 7/2015 Meyer ..... A61M 5/204 601/160
2015/0224020 A1* 8/2015 Flyash ..... A61H 23/02 601/46
2015/0257521 A1 9/2015 Hendler et al.
2015/0265825 A1* 9/2015 Miller ..... A61N 1/325 604/20
2015/0313354 A1* 11/2015 Mongan ..... A47K 7/03 15/22.1
2016/0120375 A1* 5/2016 Philips ..... A47K 7/043 15/22.1
2016/0151238 A1* 6/2016 Crunick ..... A61H 23/0218 601/2
2016/0175188 A1* 6/2016 Rabil ..... A61H 23/0263 601/18
2017/0156974 A1* 6/2017 Griner ..... A61H 23/006
2017/0304145 A1* 10/2017 Pepe ..... A61H 23/006
2017/0347789 A1* 12/2017 Zou ..... A46B 13/04
2018/0078450 A1* 3/2018 Erikson ..... A61H 23/0263
2018/0168913 A1 6/2018 Sedic
2018/0242796 A1* 8/2018 Moffitt ..... A46B 11/0062
2018/0361137 A1* 12/2018 Kern ..... A46B 15/0022
2018/0369060 A1* 12/2018 Whittle ..... A61H 7/003
2019/0117497 A1* 4/2019 Sedic ..... A61B 5/0531
2019/0142691 A1* 5/2019 Sedic ..... A61H 23/02 601/18
2020/0078151 A1* 3/2020 Plotka ..... A46B 5/0016
2020/0093945 A1* 3/2020 Jeong ..... A61L 2/26
2020/0154874 A1* 5/2020 Tammabattula ..... A46B 13/023
2020/0232535 A1* 7/2020 Bosman ..... A61C 17/34

OTHER PUBLICATIONS

International Search Report and Written Opinion, dated Mar. 13, 2020, issued in related International Patent Applicant No. PCT/US2019/065179, filed Dec. 9, 2019, 16 pages.
First Office Action, Chinese Application No. 201980081554.X, dated Mar. 1, 2022, 8 pages.

* cited by examiner

SKINCARE DEVICE HAVING OPTIMIZED DUAL ENERGY MODALITIES, AND ASSOCIATED SYSTEMS AND METHODS

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one embodiment, a skincare device includes a body having protruding elements configured for contacting a skin of a user, where the protruding elements are configured to vibrate in operation. The skincare device also includes an end effector configured for contacting the skin of the user, where the end effector is configured to oscillate about an axis during operation.

In an aspect, the body carries a resonant structure configured to generate vibrations of the protruding elements. In another aspect, the resonant structure includes: a first resonant structure configured to resonate at a first resonant frequency; and a second resonant structure configured to resonate at a second resonant frequency. The first resonant frequency may be different from the second resonant frequency.

In an aspect, the protruding elements comprise a first plurality of protruding elements having a first size and a second plurality of protruding elements having a second size different from the first size. The first resonant structure is configured to impart the first resonant frequency onto the first plurality of protruding elements, and the second resonant structure is configured to impart the second resonant frequency onto the second plurality of protruding elements.

In an aspect, the first plurality of protruding elements has a first shape and the second plurality of protruding elements has a second shape different from the first shape.

In an aspect, the resonant structure is a metal wire or strip caused to vibrate at least in part by oscillations of the end effector.

In another aspect, the resonant structure includes at least one piezoelectric element configured to constrict and expand based on a voltage supplied to the piezoelectric element.

In an aspect, the resonant structure extends radially away from the end effector.

In an aspect, the end effector is a face brush.

In an aspect, the vibration of the protruding elements is at least in part caused by oscillations of the end effector. In an aspect, the end effector carries at least one rotating first magnet and the body carries at least one stationary second magnet opposite from the rotating first magnet. The protruding elements vibrate at least in part based on magnetic interactions between the at least one rotating first magnet and the at least one stationary second magnet.

In an aspect, the body comprises an opening for a hand of the user. In another aspect, the body is made of silicon material.

In an aspect, the skincare device also includes a first charging coil carried by a charging stand, and a second charging coil carried by the body, where the first charging coil is configured to receive electrical energy through electromagnetic interactions with the second charging coil.

In an aspect, the body comprises a printed circuit board (PCB) with a controller configured to control operation of the end effector.

In one embodiment, a skincare device includes: an oscillating brush head configured to contact a skin of a user; and a body having protruding elements configured to contact the skin of the user, where the protruding elements are configured to vibrate in response to a source of vibrations.

In an aspect, the source of vibrations is a resonant structure carried by the body. In another aspect, the resonant structure is a piezoelectric element configured to constrict and expand based on a voltage supplied to the piezoelectric element.

In an aspect, the resonant structure extends radially away from the end effector.

In an aspect, the resonant structure includes: a first resonant structure configured to resonate at a first resonant frequency; and a second resonant structure configured to resonate at a second resonant frequency, where the first resonant frequency is different from the second resonant frequency.

In an aspect, the protruding elements include a first plurality of protruding elements having a first size and a second plurality of protruding elements having a second size different from the first size. The first resonant structure is configured to impart the first resonant frequency onto the first plurality of protruding elements, and the second resonant structure is configured to impart the second resonant frequency onto the second plurality of protruding elements.

In an aspect, the skincare device also includes: a motor, a shaft mechanically connecting the motor with the oscillating brush head; a first plurality of magnets carried by the oscillating brush head; and a second plurality magnets carried by the body. The second plurality of magnets faces the first plurality of magnets at least at some angular positions of the oscillating brush head. The resonant structure is a plurality of metal wires or strips configured to vibrate at least in part based on interactions between the first plurality of magnets and the second plurality of magnets.

DESCRIPTION OF THE DRAWINGS

The foregoing aspects and the attendant advantages of the inventive technology will become more readily appreciated as the same become better understood by reference to the following detailed description, when taken in conjunction with the accompanying drawings, wherein.

DETAILED DESCRIPTION

The following disclosure describes various embodiments of systems and associated methods for measuring and indicating brush head life. A person skilled in the relevant art will also understand that the technology may have additional embodiments, and that the technology may be practiced without several of the details of the embodiments described below with reference to FIGS. 1-5C.

Briefly described, skincare devices and methods having dual energy modalities are described herein. In some embodiments, the device includes an oscillating end effector and a plurality of protruding elements (also referred to as "bead heads" or "vibratory beads") distributed over the outer surface of the device. In operation, the end effector (e.g., a face brush) oscillates to impart motion onto skin of a user. These oscillations of the end effector may provide vibratory excitations to the protruding elements. The protruding elements are in contact with skin of the user, and they vibrate skin of the user in addition to the action of the end effector. The inventive device may include an opening for user's hand for improved handling of the specific areas of the user's skin.

In some embodiments, the vibrations that originate at the end effector are transferred to the protruding elements through resonant structures (e.g., through passive resonant structures). In other embodiments, the vibrations of the protruding elements are generated by the resonant structures themselves (e.g., by active resonant structures). A non-limiting example of such active resonant structure is a piezo element that expands and constricts in response to the application of alternate current (AC) source.

In some embodiments, the resonant structure includes wires or strips of material, for example metals. Different part of the resonant structure may be designed and sized to resonate at different frequencies. For example, one part of the resonant structure may resonate at a lower frequency than another part of the resonant frequency. Without being bound to theory, it is believed that lower frequencies of vibration affect deeper layers of tissue, while higher frequencies of vibration affect more topical layers of tissue. Furthermore, without being bound to theory, it is believed that different frequencies of the protruding elements in contact with skin may have different thermal effects on the skin. In some embodiments, multiple vibration frequencies and/or thermal effects at the skin of user enhance therapeutic outcomes or pleasure sensation of the user. These multiple vibration frequencies and thermal effects are collectively referred to as dual energy or multi energy modalities.

Figure 1A:
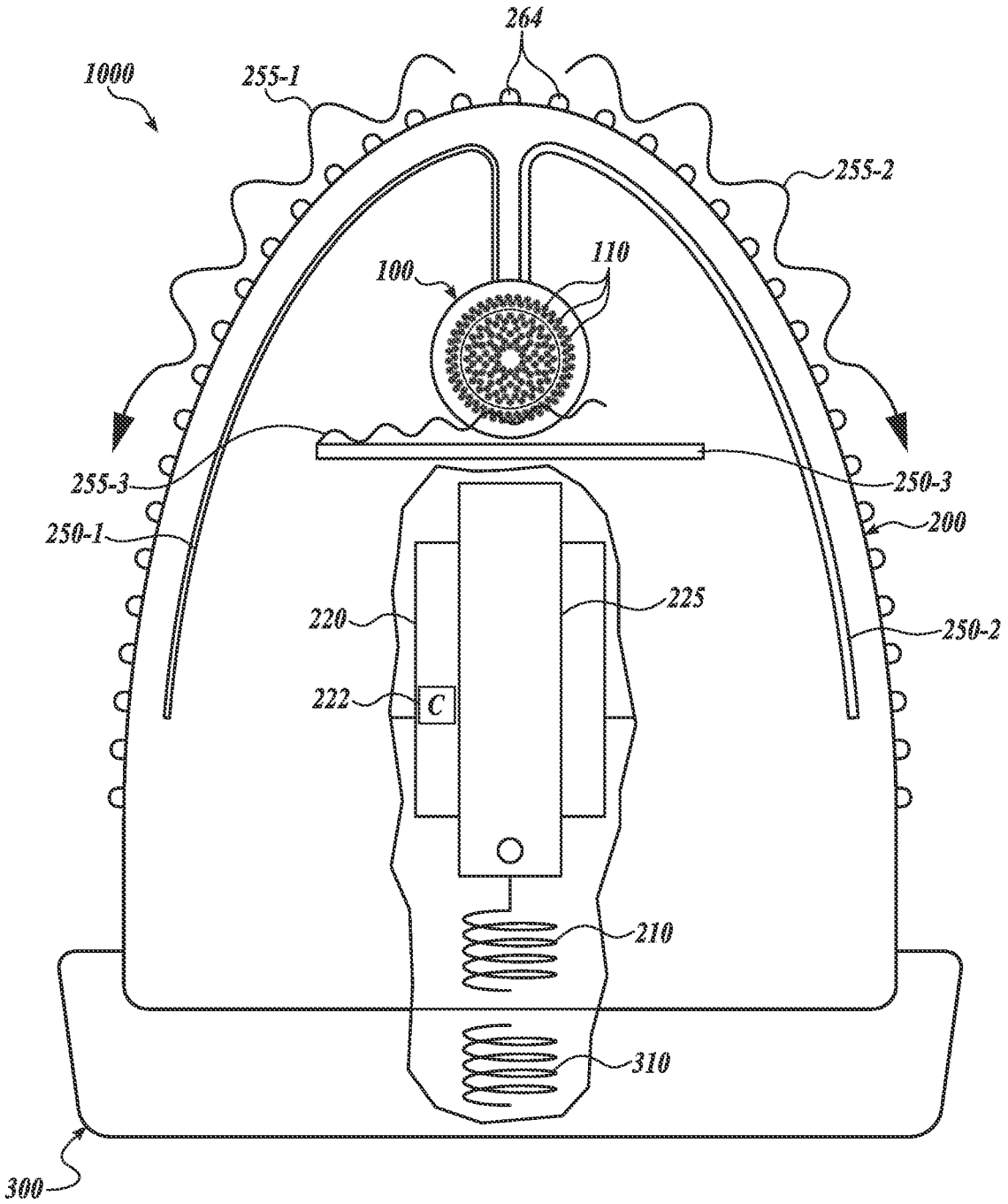
FIG. 1A is a front plan view of a skincare device in accordance with an embodiment of the present technology.

FIG. 1A is a front plan view of a skincare device in accordance with an embodiment of the present technology. In some embodiments, the skincare device 1000 is a face brush having a brush head (end effector) 100 that oscillates about a center axis when in operation. The oscillatory motion of the brush head 100 may cause vibrations 255-1, 255-2 (collectively referred to as vibrations 255) that are transferred through resonant structures 250 onto protruding elements 264. The peripherally distributed protruding elements 264 are illustrated in FIG. 1A, but other distributions of the protruding elements 264 are also possible.

In some embodiments, the resonant structures 250 include metal profiles (e.g., metal lines, metal strips, metal wires, etc.). The illustrated resonant structures 250 are distributed symmetrically with respect to the centerline of the device, but other distributions, for example non-symmetrical, are also possible.

Different parts of the resonant structures 250 may have different resonant properties (e.g., resonant frequencies) that promote different vibration modes. For example, the resonant structure 250-1 may be relatively thin having a relatively small area moment of inertia (bending moment), thus resulting in a relatively low resonant frequency f1. On the other hand, the resonant structure 250-3 may be relatively thick and short, thus having a relatively high resonant frequency f3. Resonant properties of the resonant structure 250-2 may be between those of the resonant structures 250-1 and 250-3, thus having a resonant frequency f2 that is between frequencies f1 and f3. Therefore, by sizing and shaping individual resonant structures 250 of the device, different zones of the skincare device 1000 may be designed and optimized to have different vibration frequencies.

In some embodiments, the device 1000 is manufactured of soft materials, for example, latex, soft rubber or soft plastic. The protruding elements 264 may be manufactured of soft or hard materials, for example, hard plastic or rubber. In different embodiments, the protruding elements 264 may have different size and/or shape as described below with reference to FIG. 1C and FIG. 2.

The skincare device 1000 may be controlled by a controller 222 that is carried by a circuit board 220. The device 1000 may be powered by a battery 225 and/or pairs of charging coils 210/310. The device 1000 may be rechargeable through a charging stand 300.

Figure 1B:
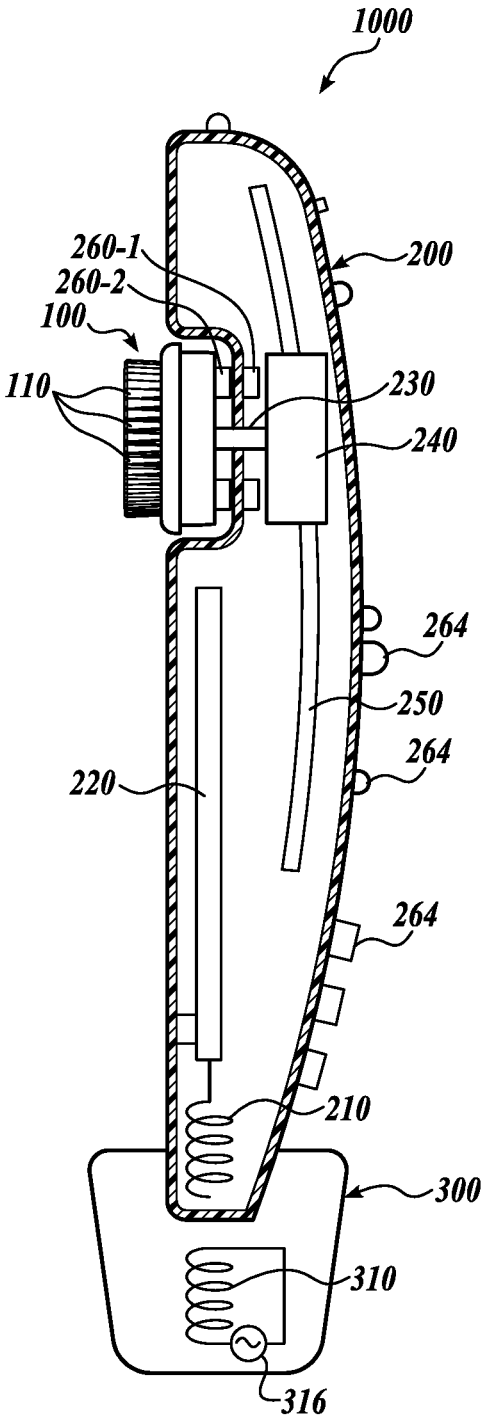
FIG. 1B is a cross-sectional side view of the skincare device shown in FIG. 1A.

FIG. 1B is a cross-sectional side view of the skincare device 1000 shown in FIG. 1A. In operation, the brush head 100 is driven to oscillate about a central axis by a shaft 230, while bristles 110 contact skin of the user. A motor 240 may be powered from a source of alternating current 316 through the charging coil 210/310.

In some embodiments, a housing 200 carries a plurality of magnets 260-1, and the brush head 100 carries the opposing plurality of magnets 260-2. As the magnets 260-2 oscillate around the center axis, the opposing magnets experience attractive and repulsive forces as different magnetic poles face each other, resulting in vibrations of the housing 200. These vibrations may be transferred to the resonant structure 250 and further to the protruding elements 264, as explained with reference to FIG. 1C below.

Figure 1C:
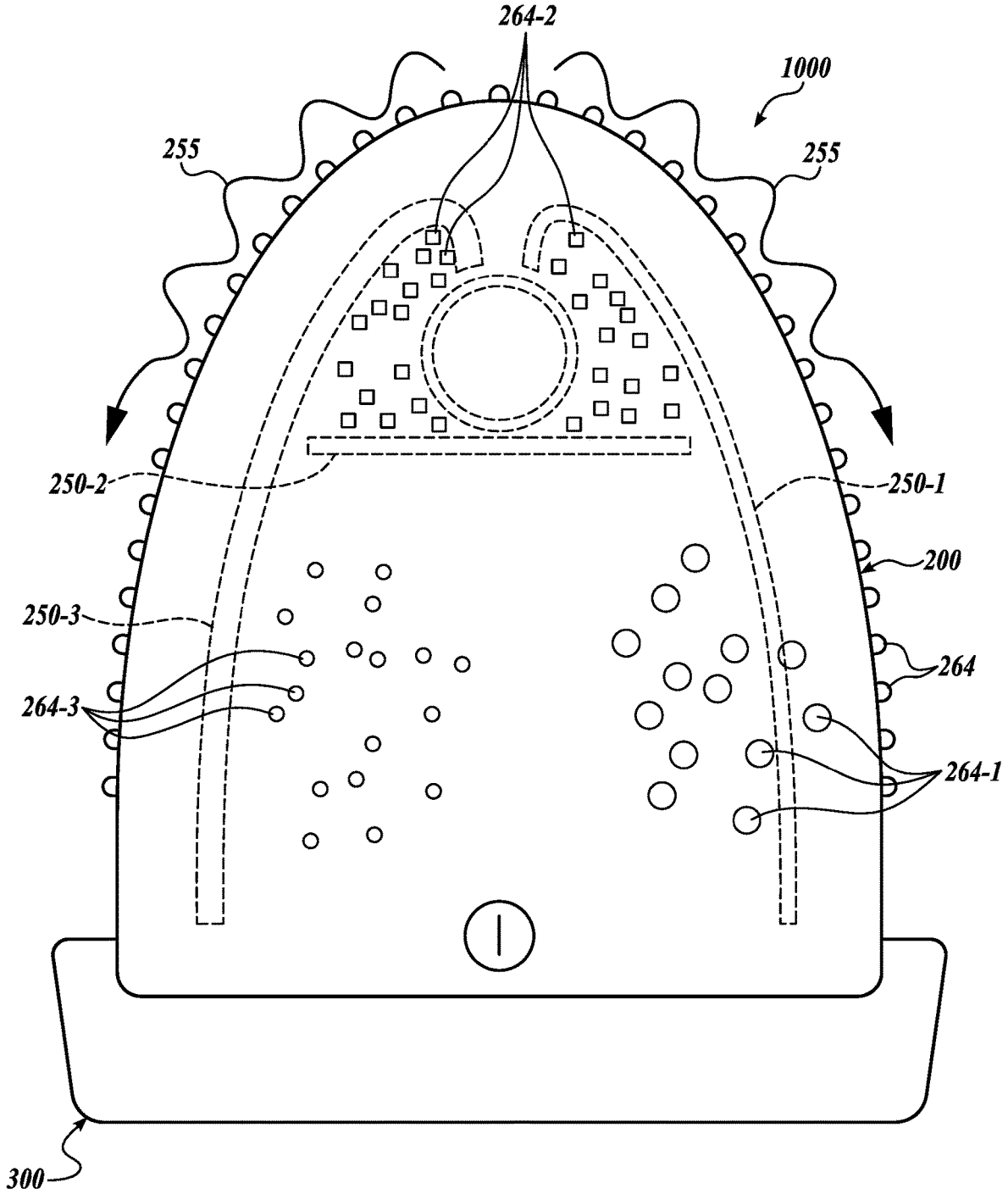
FIG. 1C is a back plan view of the skincare device shown in FIG. 1A.

FIG. 1C is a back plan view of the skincare device shown in FIG. 1A. The illustrated skincare device 1000 includes several groups of protruding elements 264. In operation, these different groups of the protruding elements 264 may vibrate at different frequencies, based on their proximity to one or more resonant structures 250. For example, the protruding elements 264-1 may vibrate at the relatively low resonant frequency f1 of the resonant structure 250-1. Without being bound to theory, it is believed that a relatively large size of the protruding elements 264-1 coupled with a relatively low vibration frequency f1 may result in, for example, enhanced thermal effects on skin of the user and/or increased depth of the tissue treatment. Conversely, a relatively small size of the protruding elements 264-3 coupled with a relatively high vibration frequency f3 may result in a decreased depth of the tissue treatment. In some embodiments, the protruding elements 264-1, 264-2 and 264-3 have different shapes. In the illustrated embodiment, three groups of the protruding elements 264 are shown. However, different embodiments of the skincare device may include different number of groups of protruding elements.

Figure 2:
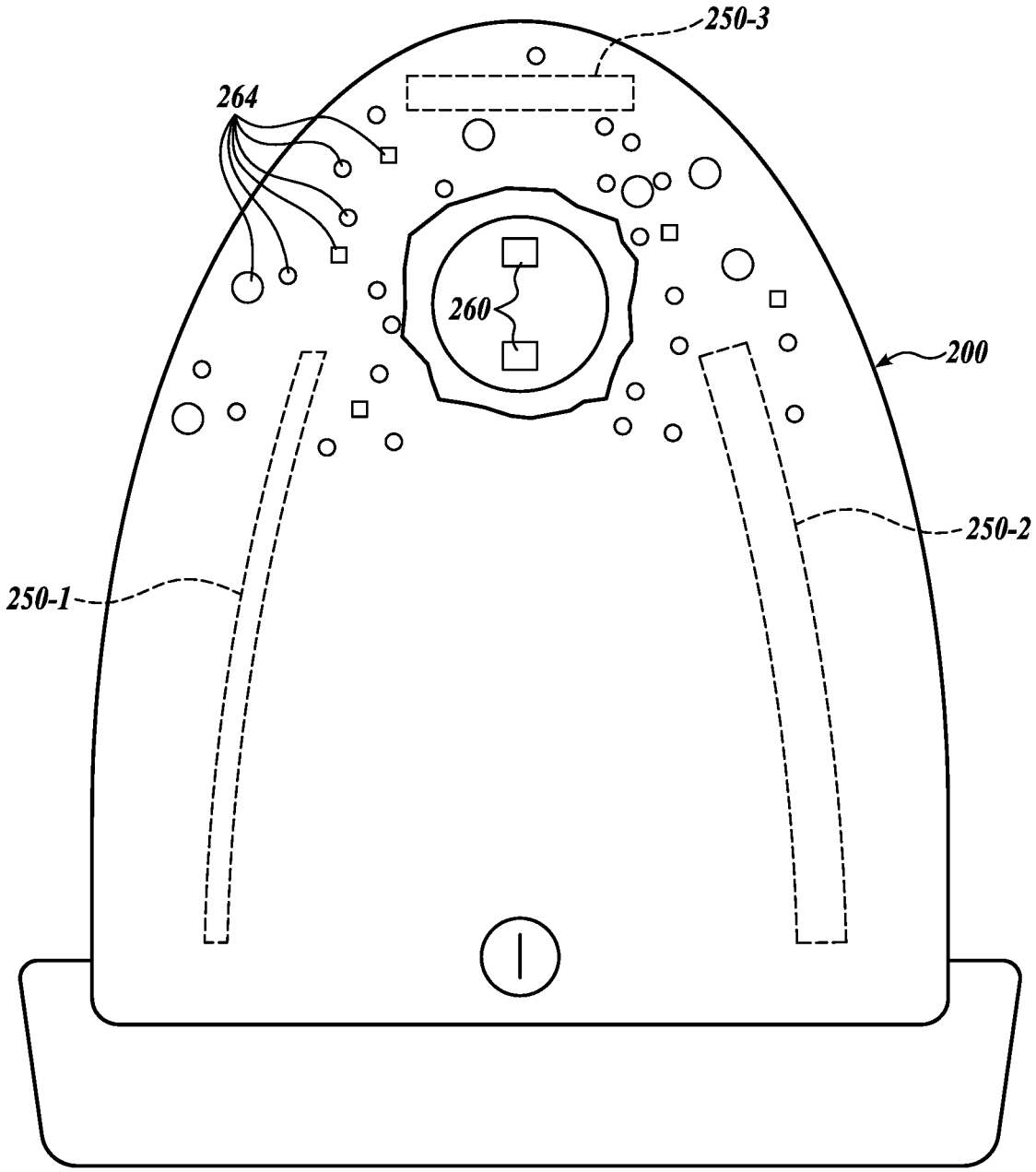
FIG. 2 is a partial plan view of a skincare device in accordance with an embodiment of the present technology.

FIG. 2 is a partial plan view of a skincare device 1000 in accordance with an embodiment of the present technology. In this partial view, the brush head 100 is removed making the magnets 260 visible in the housing 200. In other embodiments, elements 260 may be other sources of vibration, for example, piezo elements that vibrate in response to an alternating current.

The illustrated embodiment of the skincare device includes protruding elements 264 with different sizes and shapes. These protruding elements may vibrate at different frequencies based on frequencies of oscillation of the resonant structures 250.

Figure 2A:
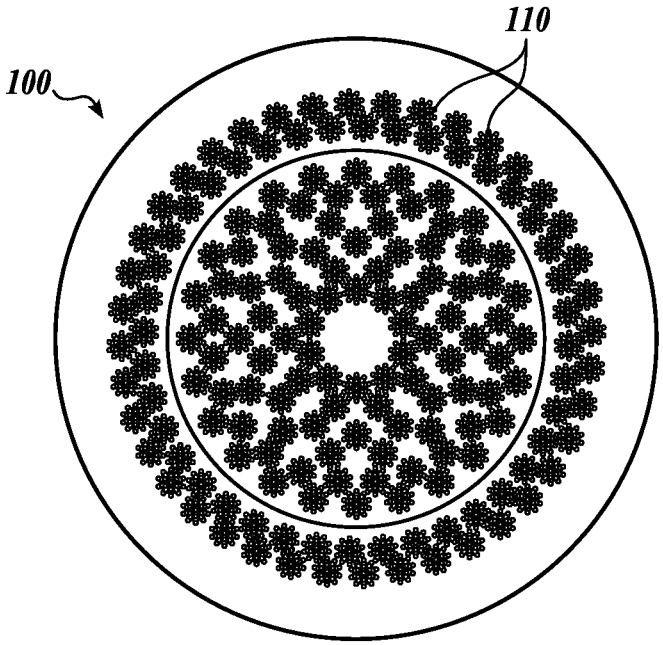
FIG. 2A is a front plan view of a face brush in accordance with an embodiment of the present technology.
Figure 2B:
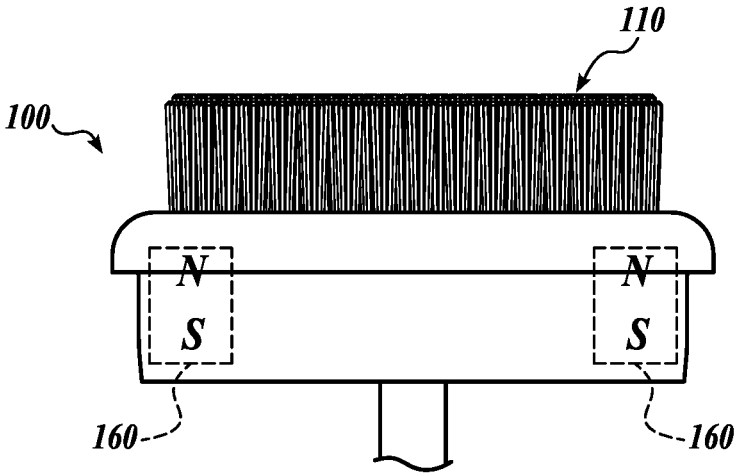
FIG. 2B is a side view of the face brush shown in FIG. 2B.

FIG. 2A is a front plan view of a face brush in accordance with an embodiment of the present technology. The illustrated face brush 100 includes bristles 110 that contact user's skin as the brush head 100 oscillates. FIG. 2B is a side view of the face brush shown in FIG. 2A. The face brush 100 includes a plurality of magnets 160 having the north poles facing the bristles 110 and the south poles facing the opposing magnets of the housing (not shown). In different embodiments, the N-S orientation and the number of magnets 160 may be different.

Figure 3:
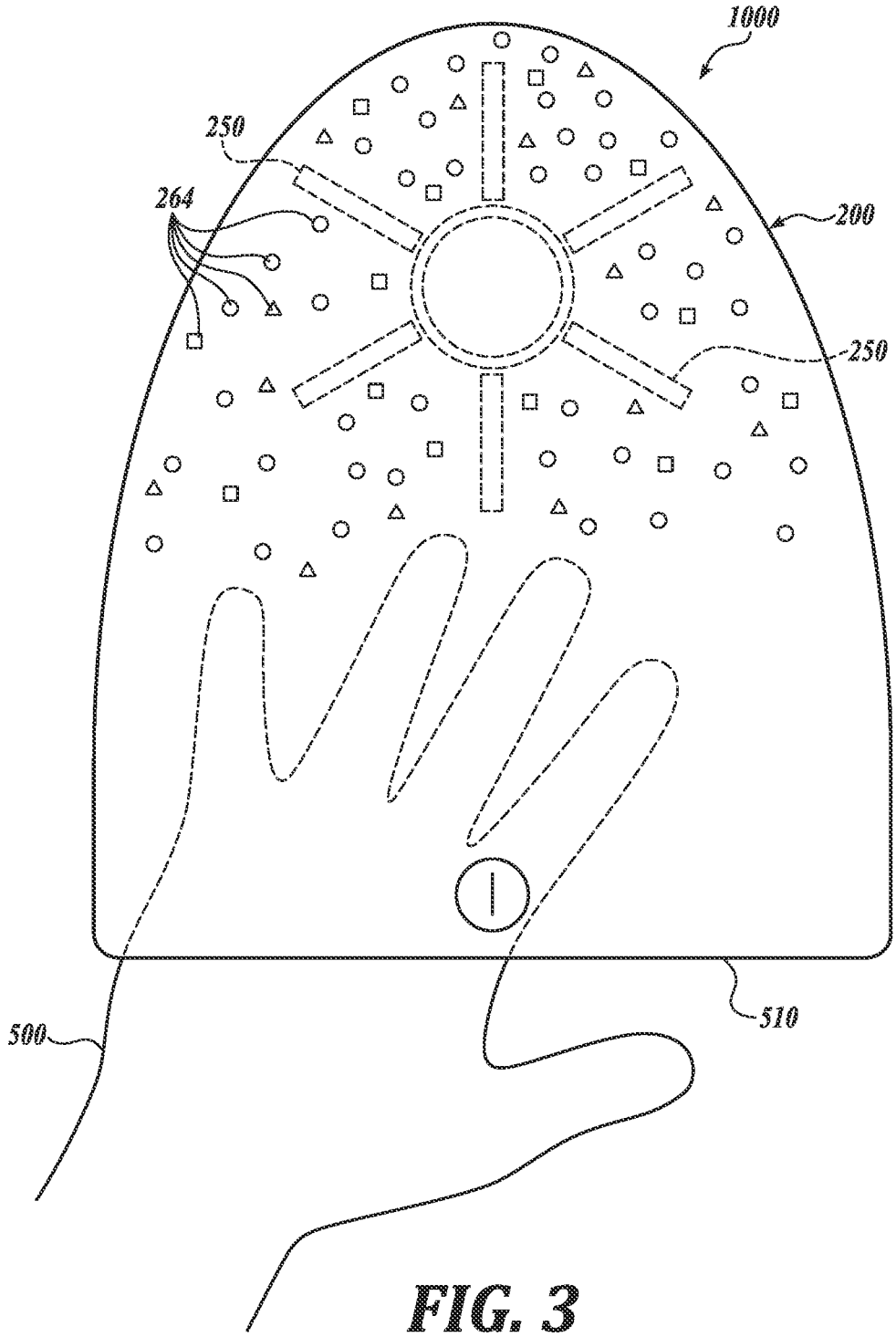
FIG. 3 is a partially schematic view of a skincare device in accordance with an embodiment of the present technology.

FIG. 3 is a partially schematic view of a skincare device in accordance with an embodiment of the present technology. In some embodiments, the skincare device 1000 may include an opening 510 for user's hand 500. In operation, the user may bring the skincare device 1000 into contact with face to achieve, for example, desired face massage or thermal effects. Illustrated skincare device 1000 includes a set of radially arranged resonant structures 250, but other arrangements are also possible. The illustrated protruding elements 264 may have different size, hardness, smoothness of their outer surface, thermal properties, or other properties relevant to tactile or thermal sensation of the user.

Figure 4A:
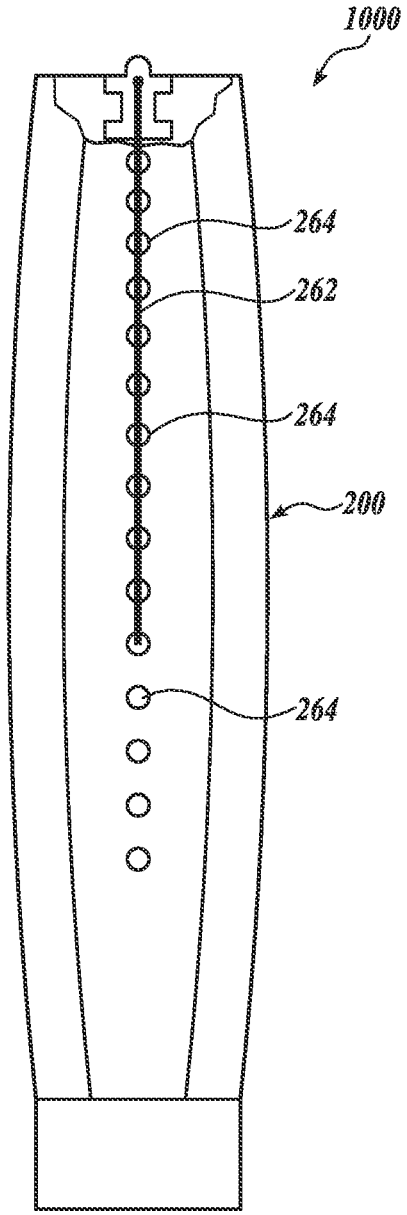
FIG. 4A is a side view of a skincare device in accordance with an embodiment of the present technology.
Figure 4B:
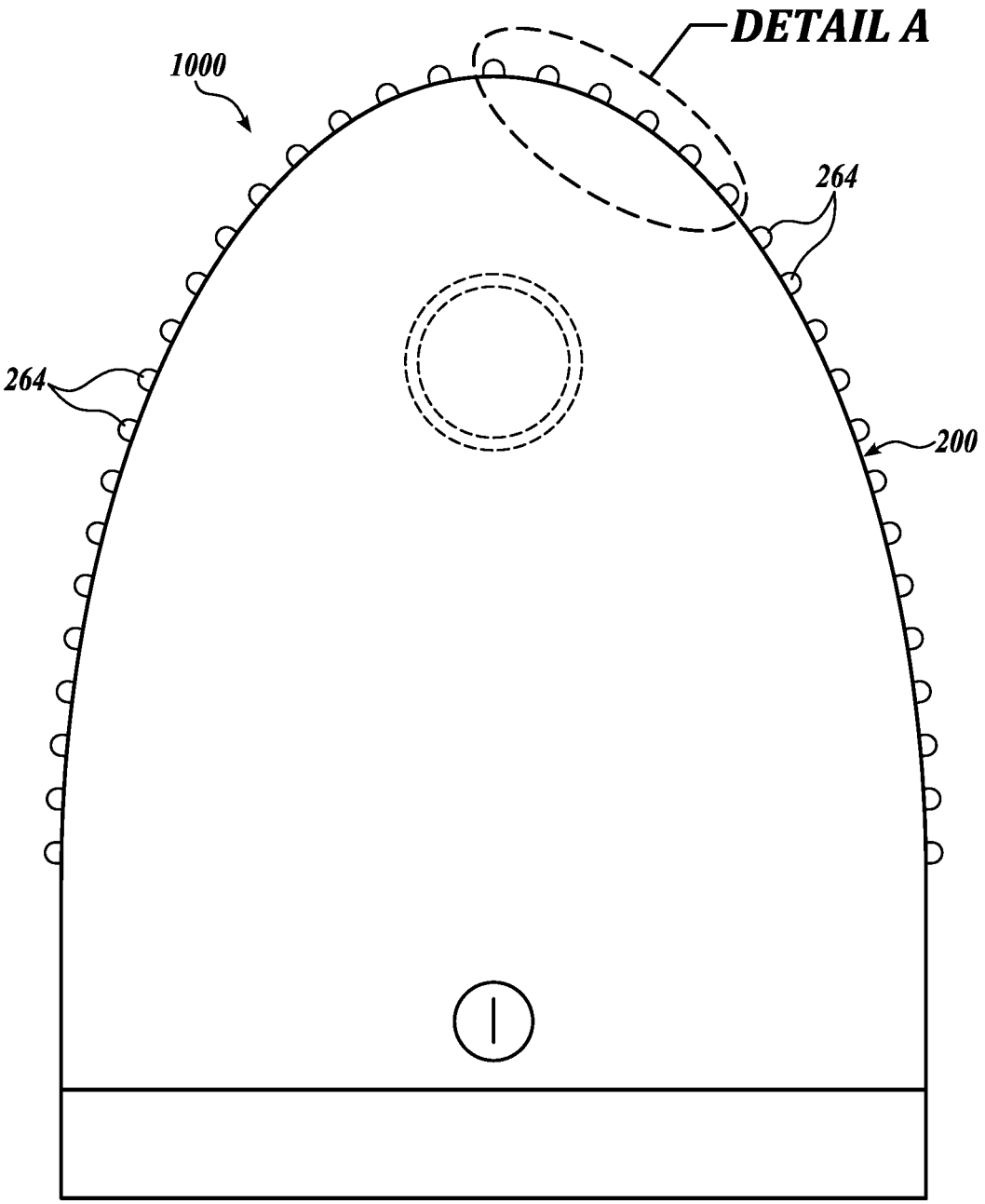
FIG. 4B is a back view of a skincare device shown in FIG. 4A.

FIG. 4A is a side view of a skincare device in accordance with an embodiment of the present technology. The illustrated embodiment includes an active resonant structure 262 that vibrates the protruding elements 264. FIG. 4B is a back view of a skincare device shown in FIG. 4A. The protruding elements 264 are arranged along the side edges of the skincare device 1000, but in different embodiments the protruding elements 264 may be arranged in other zones of the skincare device. For example the protruding elements 264 may be arranged over the front and back sides of the skincare device 1000. Detail A of FIG. 4B is shown in FIGS. 5A-5C.

Figure 5A:
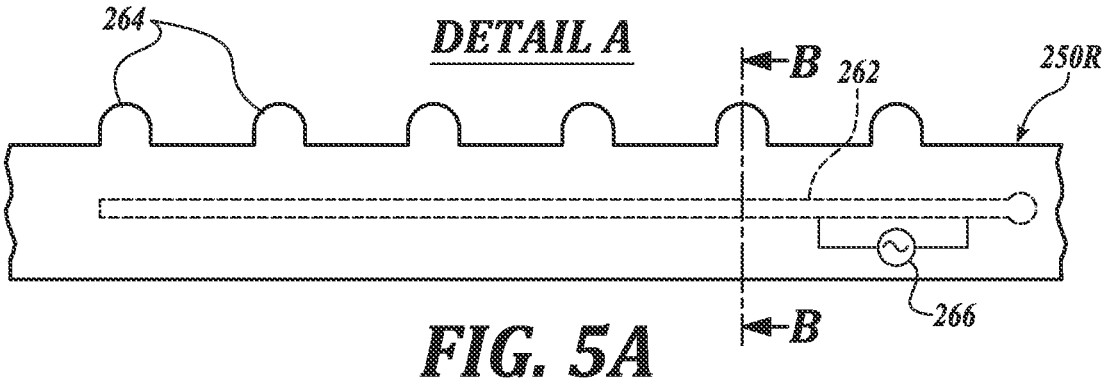
FIGS. 5A and 5B are detail views of the skincare device shown in FIG. 4B.
Figure 5B:
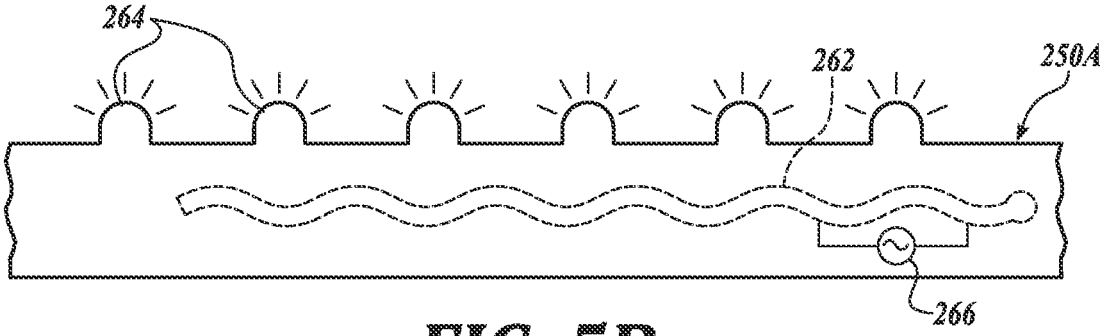

FIGS. 5A and 5B are detail views of the skincare device shown in FIG. 4B. FIG. 5A illustrates the resonant structure 262 in its unpowered, inactive state or at-rest state 250R. FIG. 5B illustrates the resonant structure 262 in its powered or active state 250A. The resonant structure 262 may be a piezo element connected to source of AC voltage. When in its active state, the resonant structure 262 is energized by AC voltage from the source of energy 266. Generally, a frequency of the source 266 determines vibration frequency of the resonant structure 262, therefore at least in part determining vibration frequency of the protruding elements 264. In some embodiments, vibration frequency of the resonant structure 262 can be a multiple or a fraction of the frequency of the AC source 266. The illustrated embodiment includes a single resonant structure 262 powered by one AC source 266. However, in different embodiments the skincare device may include multiple resonant structures 262 that are powered by dedicated AC sources 266 operating at different frequencies.

Figure 5C:
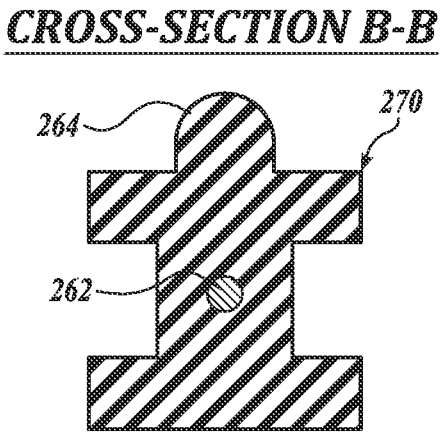
FIG. 5C is a cross-sectional view of the Detail A of FIG. 5A.

FIG. 5C is a cross-sectional view of the Detail A of FIG. 5A. In the illustrated embodiment, the resonant structure 262 and the protruding elements 264 comprise a vibration transducer 270. The resonant structure 262 may be embedded into material that carries the protruding element 264. In some embodiments, the size and/or shape of the cross-section of the resonant structure 262 may at least in part determine the amplitude of oscillation of the protruding elements, while the frequency of the AC source 266 determines the frequency of the vibrations.

Many embodiments of the technology described above may take the form of computer- or controller-executable instructions, including routines executed by a programmable computer or controller. Those skilled in the relevant art will appreciate that the technology can be practiced on computer/controller systems other than those shown and described above. The technology can be embodied in a special-purpose computer, controller or data processor that is specifically programmed, configured or constructed to perform one or more of the computer-executable instructions described above. Accordingly, the terms "computer" and "controller" as generally used herein refer to any data processor and can include Internet appliances and hand-held devices (including palm-top computers, wearable computers, cellular or mobile phones, multi-processor systems, processor-based or programmable consumer electronics, network computers, mini computers and the like).

From the foregoing, it will be appreciated that specific embodiments of the technology have been described herein for purposes of illustration, but that various modifications may be made without deviating from the disclosure. For example, in some embodiments the counter or controller may be based on a low-power buck regulator connected to a capacitor. Moreover, while various advantages and features associated with certain embodiments have been described above in the context of those embodiments, other embodiments may also exhibit such advantages and/or features, and not all embodiments need necessarily exhibit such advantages and/or features to fall within the scope of the technology. Accordingly, the disclosure can encompass other embodiments not expressly shown or described herein.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," etc., mean plus or minus 5% of the stated value.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

I claim:

1. A face massage skincare device, comprising:

a body having protruding elements configured for contacting a face of a user, wherein the body carries a resonant structure operably coupled to one or more of the protruding elements, the resonant structure being configured to generate vibrations of the one or more protruding elements during operation, wherein the protruding elements are fixedly connected with the body;

an end effector having a face brush configured for contacting the face of the user while the resonant structures vibrates, wherein the end effector is configured to oscillate about an axis during operation, and wherein the protruding elements are separate from the face brush;

a motor having a shaft configured to generate oscillations of the face brush;

the resonant structure comprising a source of vibration that is separate from the motor or the shaft; and wherein the resonant structure further comprises: a first resonant structure extending peripherally along a first side of an outer edge of the body; a second resonant structure extending peripherally along a second side of the outer edge of the body, wherein the second side is opposite from the first side; and a third resonant structure extending between the first resonant structure and the second resonant structure.

2. The device of claim 1, wherein:

the first resonant structure configured to resonate at a first resonant frequency; and the second resonant structure configured to resonate at a second resonant frequency, wherein the first resonant frequency is different from the second resonant frequency.

3. The device of claim 2, wherein the protruding elements comprise a first plurality of protruding elements having a first size and a second plurality of protruding elements having a second size different from the first size, and wherein:

the first resonant structure is configured to impart the first resonant frequency onto the first plurality of protruding elements; and the second resonant structure is configured to impart the second resonant frequency onto the second plurality of protruding elements.

4. The device of claim 3, wherein the first plurality of protruding elements has a first shape and the second plurality of protruding elements has a second shape different from the first shape.

5. The device of claim 1, wherein the first, second, and third resonant structures are metal wires or strips caused to vibrate at least in part by oscillations of the end effector.

6. The device of claim 1, wherein the source of vibration comprises at least one piezoelectric element configured to constrict and expand based on a voltage supplied to the piezoelectric element.

7. The device of claim 1, wherein the first and second resonant structures extend radially away from the face brush.

8. The device of claim 1, wherein vibration of the protruding elements is at least in part caused by oscillations of the end effector.

9. The device of claim 8, wherein the end effector carries at least one rotating first magnet and the body carries at least one stationary second magnet opposite from the rotating first magnet, and wherein the protruding elements vibrate at least in part based on magnetic interactions between the at least one rotating first magnet and the at least one stationary second magnet.

10. The device of claim 1, wherein the body comprises an opening configured for placing a hand of the user into an interior of the device.

11. The device of claim 1, wherein the body is made of silicon material.

12. The device of claim 1, further comprising:

a first charging coil carried by a charging stand; and a second charging coil carried by the body, wherein the first charging coil is configured to receive electrical energy through electromagnetic interactions with the second charging coil.

13. The device of claim 1, wherein the body comprises a printed circuit board (PCB) with a controller configured to control operation of the end effector.

14. A face massage skincare device, comprising:

an oscillating brush head configured to contact a face of a user, wherein the brush head is configured to oscillate about an axis during operation; and a body having protruding elements configured to contact the face of the user, wherein the body carries a resonant structure operably coupled to one or more of the protruding elements that are configured to vibrate in response to a source of vibrations while the brush head oscillates, and wherein the protruding elements are separate from the brush head, wherein the protruding elements are fixedly connected with the body;

a motor having a shaft configured to generate oscillations of the brush head;

the resonant structure comprising a source of vibration that is separate from the motor or the shaft; and wherein the resonant structure further comprises: a first resonant structure extending peripherally along a first side of an outer edge of the body; a second resonant structure extending peripherally along a second side of the outer edge of the body, wherein the second side is opposite from the first side; and a third resonant structure extending between the first resonant structure and the second resonant structure.

15. The device of claim 14, wherein the source of vibration is a piezoelectric element configured to constrict and expand based on a voltage supplied to the piezoelectric element.

16. The device of claim 14, wherein the first and second resonant structures extend radially away from the brush head.

17. The device of claim 14, wherein:

the first resonant structure configured to resonate at a first resonant frequency; and the second resonant structure configured to resonate at a second resonant frequency, wherein the first resonant frequency is different from the second resonant frequency.

18. The device of claim 17, wherein the protruding elements comprise a first plurality of protruding elements having a first size and a second plurality of protruding elements having a second size different from the first size, and wherein:

the first resonant structure is configured to impart the first resonant frequency onto the first plurality of protruding elements; and the second resonant structure is configured to impart the second resonant frequency onto the second plurality of protruding elements.

19. The device of claim 14, further comprising:

a shaft mechanically connecting the motor with the oscillating brush head;

a first plurality of magnets carried by the oscillating brush head; and a second plurality of magnets carried by the body, where the second plurality of magnets faces the first plurality of magnets at least at some angular positions of the oscillating brush head, wherein the resonant structure is a plurality of metal wires or strips configured to vibrate at least in part based on interactions between the first plurality of magnets and the second plurality of magnets.

20. The device of claim 1, wherein the first and second resonant structures are embedded into a material that carries the protruding elements.

* * * * *